US007147520B2

(12) United States Patent
Lokietz

(10) Patent No.: US 7,147,520 B2
(45) Date of Patent: Dec. 12, 2006

(54) CONNECTION PART AND METHOD FOR PRODUCING A CONNECTION PART

(75) Inventor: Klaus Lokietz, Salzkotten-Thüle (DE)

(73) Assignee: Eupec Europaische Gesellschaft fur Leistungshalbleiter mbH, Warstein (DE)

( * ) Notice: Subject to any disclaimer, the term of this patent is extended or adjusted under 35 U.S.C. 154(b) by 0 days.

(21) Appl. No.: 11/234,902

(22) Filed: Sep. 26, 2005

(65) Prior Publication Data

US 2006/0068646 A1 Mar. 30, 2006

(30) Foreign Application Priority Data

Sep. 27, 2004 (DE) ..... 10 2004 046 808

(51) Int. Cl.
*H01R 9/22* (2006.01)

(52) U.S. Cl. ..... 439/709

(58) Field of Classification Search ..... 439/709, 439/801, 810, 814
See application file for complete search history.

(56) References Cited

U.S. PATENT DOCUMENTS 4,529,261 A * 7/1985 Stenz et al. ..... 439/810
4,802,863 A * 2/1989 Debus ..... 439/387
5,368,506 A * 11/1994 Heimbrock ..... 439/709
5,595,505 A * 1/1997 Duke et al. ..... 439/630
5,713,766 A * 2/1998 Davies et al. ..... 439/709
5,989,073 A * 11/1999 Kahoun ..... 439/709
5,993,267 A * 11/1999 Lin ..... 439/709
6,824,432 B1 * 11/2004 Katsuzawa et al. ..... 439/709
2004/0033730 A1 * 2/2004 Oda ..... 439/709
2004/0214477 A1 * 10/2004 Ikeda ..... 439/709

FOREIGN PATENT DOCUMENTS

DE 34 12 244 C2 1/1987
DE 37 14 500 C1 8/1988
DE 196 54 384 A1 6/1998

* cited by examiner

*Primary Examiner*—Tulsidas C. Patel
*Assistant Examiner*—Vladijmir Imas
(74) *Attorney, Agent, or Firm*—Baker Botts L.L.P.

(57) ABSTRACT

A connection part has a plastic body (1) and at least one electrical connection element (4, 5) having a fixing region (4*a*, 5*a*) which is injection molded into the plastic body (1), and having a connection lug (4*b*, 5*b*) which has a cutout (12, 13) for a screw connecting element. A corresponding connecting element (8, 9) can be introduced into a receiving area (2, 3) beneath the connection lug (4*b*, 5*b*). At least one latching element (10, 11; 14, 15) holds the corresponding connecting element (8, 9) in the receiving area (2, 3) such that it cannot fall out once it has been inserted. A connection part is thus created which has a securely and permanently fixed connection element with cost-effective production and, at the same time, makes it possible to compensate for the tolerance with respect to a contact element to be mounted externally.

9 Claims, 1 Drawing Sheet

CONNECTION PART AND METHOD FOR PRODUCING A CONNECTION PART

CROSS-REFERENCE TO RELATED APPLICATIONS

This application claims priority from German Patent Application No. 10 2004 046 808.7-34, which was filed on Sep. 27, 2004, and is incorporated herein by reference in its entirety.

TECHNICAL FIELD

The invention relates to connection parts and to the production of connection parts in the field of electrical or electronic devices and assemblies using plastics.

BACKGROUND

Here, it is often necessary to provide connection elements which can be subjected to high loads and are suitable for external electrical connection. Such elements designed for high currents are also referred to in the context of the present invention as load connections. Said load connections generally have a connection lug having a hole. A connecting screw can engage through the hole and be screwed to a corresponding screw element arranged beneath the lug, for example a screw nut. An external connection, for example by means of a screw-connected contact element, can thus be realized.

In order to compensate for tolerances between the connection element and the external contact element to be mounted, the corresponding connecting element (screw nut) needs to be capable of moving. It can therefore not be injection molded into the plastic base body, generally provided, of the connection part.

Against this background it is conceivable for the load connection to be inserted into the plastic body by means of a fixing section or fixing region (part of the load connection) such that the connection lug overlaps the screw nut once said screw nut has been placed beneath the lug. The plug or clamping connection thus formed does not, however, ensure reliable fixing of the load connection in all operating situations.

The fixing region of the load connection could also be injection molded into the plastic body and the connection lug bent back onto the screw nut once said screw nut has been inserted. This has the advantage of a reliable fixing of the load connection to the plastic body, but requires an additional bending operation over an undefined bending edge. This may require readjustment of the connection lug. The bending brings about high loads on the plastic at the bending edge and may produce cracks in the connection lug which may lead to breakage owing to the operating conditions (for example temperature change, vibrations).

SUMMARY

Against this background, the object of the invention is to provide a connection part which has a securely and permanently fixed load connection but with a movable screw nut along with cost-effective production. In addition, a method for producing such a connection part will be specified.

This object can be achieved by a connection part comprising a plastic body, at least one electrical connection element, a fixing region which is injection molded into the plastic body, a connection lug which has a cutout for a screw connecting element, a corresponding connecting element, a receiving area beneath the connection lug into which the corresponding connecting element can be introduced from outside and which receives said corresponding connecting element, and at least one latching element which holds the corresponding connecting element in the receiving area such that it cannot fall out once it has been inserted.

The corresponding connecting element can be a square nut. Two latching elements can be in the form of latching hooks gripping the corresponding connecting element laterally.

The object can also be achieved by a method for producing a connection part, comprising the steps of injection molding a fixing region of a connection element having a connection lug into a plastic body, introducing a connecting element which corresponds to an external screw connecting element from the outside into a receiving area, delimited by the plastic body, beneath the connection lug, and providing on the plastic body at least one latching element which holds the corresponding connecting element in the receiving area such that it cannot fall out once it has been inserted.

One significant aspect of the invention thus consists in injection molding the fixing region of a ready-bent load connection into the plastic body such that the connection lug partially delimits the receiving area of the screw nut and covers that of the connecting element. As a further important aspect of the invention, this makes it possible for the corresponding connecting element to be introduced into the receiving area from the outside and to be held there by at least one latching element such that it cannot fall out.

A permanent, mechanically robust connection between the load connection and the plastic body is thus realized and subsequent processing (for example bending or aligning processes) of the load connection is not required. Material loads on the load connection and the plastic body and the risk of resultant cracks forming in the load connection are thus prevented.

The corresponding connecting element is preferably a screw nut, in particular a square nut. Further preferably, two latching elements may be provided in the form of latching hooks gripping the corresponding connecting element laterally.

BRIEF DESCRIPTION OF THE DRAWINGS

The invention will be explained by way of example in more detail beneath with reference to a drawing, in which.

DETAILED DESCRIPTION

Figure 1:
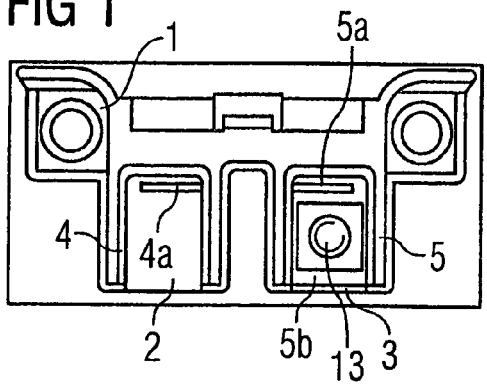
FIGS. 1 to 4 show method steps in the production of a connection part according to the invention.

FIG. 1 shows a plastic body 1 having two receiving areas 2, 3 for in each case one square nut. Two load connections 4, 5 having their respective fixing region 4*a*, 5*a* are injection molded into the plastic body and thus have a secure, fixed and permanent hold in the plastic body. In the case of the left-hand load connection 4, the connection lug has been removed in FIGS. 1 to 3 in order to illustrate the invention. In contrast, the right-hand side shows the completely equipped plastic body, i.e. the load connection 5 with a connection lug 5*b*.

Figure 2:
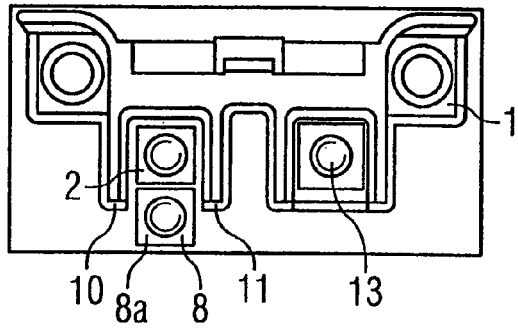

In order to illustrate the production, FIG. 2 shows the insertion of a square nut 8 into the receiving area 2 which is formed in the plastic body 1 and is located beneath the left-hand connection lug (which has only been removed here for illustrative purposes). The square nut acts as a corresponding connecting element for a screw connecting element (not illustrated). The square nut is therefore mounted only subsequently, after the injection molding process for the purpose of producing the plastic body 1 and the simultaneous injection molding of the fixing part 4*a*.

Figure 3:
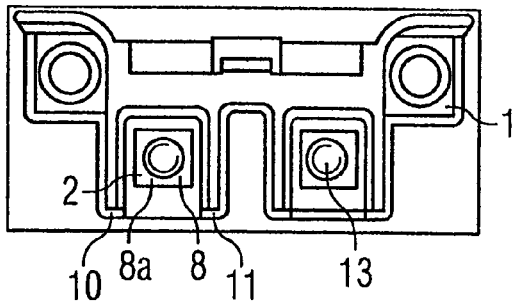

Two lateral latching hooks 10, 11 spring open laterally during the insertion and spring back behind their outer end face 8*a* when the square nut 8 has been completely inserted (FIG. 3). The nut 8 is thus capable of moving with play and thus in a desirable manner, but is held in the receiving area 2 such that it cannot fall out.

Figure 4:
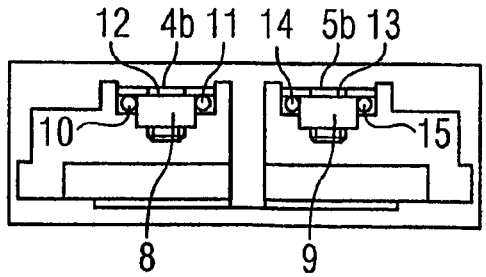

FIG. 4 shows a complete connection part, i.e. with the respective connection lugs 4*b*, 5*b* of the load connections 4, 5. These load connections 4, 5 each have a through-hole 12 (cf. also FIGS. 1 to 3) and 13, respectively, through each of which a screw connecting element in the form of a metal screw can pass in order to electrically connect the load connections in each case to a contact-making lug.

The screw connecting elements in this case come into screw-like engagement with the internal thread of the square nuts 8, 9 which are held in the receiving areas 2, 3 by the latching elements (latching hooks) 10, 11 and 14, 15, respectively, such that they cannot fall out but such that they can move to such an extent that they make possible, owing to their ability to move, adaptation to the longitudinal axis of the screw to be matched and, as a result, compensation of tolerances between the connection element and the external contact element to be mounted. The square nut thus forms in each case a corresponding connecting element for said metal screw.

LIST OF REFERENCES

1 Plastic body
2 Receiving area
3 Receiving area
4 Load connection
4*a* Fixing region
4*b* Connection lug
5 Load connection
5*a* Fixing region
5*b* Connection lug
8 Square nut
8*a* End side
9 Square nut
10 Latching hook
11 Latching hook
12 Through-hole
13 Through-hole
14 Latching hook
15 Latching hook

What is claimed is:

1. A connection part comprising:
a plastic body,
at least one electrical connection element,
a fixing region which is injection molded into the plastic body,
a connection lug which has a cutout for a screw connecting element,
a corresponding connecting element,
a receiving area beneath the connection lug into which the corresponding connecting element can be inserted in a insertion direction from outside and which receives said corresponding connecting element, and
two lateral latching hooks designed to spring open laterally in a direction perpendicular to the insertion direction which hold the corresponding connecting element in the receiving area such that it cannot fall out once it has been inserted but wherein it can move within the receiving area sufficiently to adapt to a longitudinal axis of the screw connecting element.

2. A connection part according to claim 1, wherein the corresponding connecting element is a square nut.

3. A connection part according to claim 2, wherein the square nut has front and bottom walls and sidewalls perpendicular to the front and bottom walls.

4. A method for producing a connection part, comprising the steps of:
injection molding into a plastic body a fixing region of a connection element having a connection lug suitable for receiving a screw connecting element,
introducing a connecting element which corresponds to an external screw connecting element from the outside in a insertion direction into a receiving area, delimited by the plastic body, beneath the connection lug, and
providing on the plastic body two lateral latching hooks designed to spring open laterally in a direction perpendicular to the insertion direction which holds the corresponding connecting element in the receiving area such that it cannot fall out once it has been inserted but wherein it can move sufficiently to adapt to a longitudinal axis of the screw connecting element.

5. A method according to claim 4, wherein the corresponding connecting element is a square nut.

6. A method according to claim 5, wherein the square nut has front and bottom walls and sidewalls perpendicular to the front and bottom walls.

7. A connection part comprising:
a plastic body with an injection molded fixing region,
at least one electrical connection element,
a connection lug which has a cutout for a screw connecting element,
a receiving area beneath the connection lug into which a nut can be introduced in a insertion direction from outside and which receives said nut, and
two lateral latching hooks designed to spring open laterally in a direction perpendicular to the insertion direction which holds the nut in the receiving area such that it cannot fall out once it has been inserted but wherein it can move sufficiently to adapt to a longitudinal axis of the screw connecting element.

8. A connection part according to claim 7, wherein the nut has a square form.

9. A connection part according to claim 8, wherein the square nut has front and bottom walls and sidewalls perpendicular to the front and bottom walls.

* * * * *